US009109597B2

(12) United States Patent
Böwing et al.

(10) Patent No.: US 9,109,597 B2
(45) Date of Patent: Aug. 18, 2015

(54) VARIABLE DISPLACEMENT PUMP WITH MULTIPLE PRESSURE CHAMBERS WHERE A CIRCUMFERENTIAL EXTENT OF A FIRST PORTION OF A FIRST CHAMBER IS GREATER THAN A SECOND PORTION

(71) Applicant: Stackpole Powertrain International ULC, Mississaugua (CA)

(72) Inventors: Oliver Böwing, Aachen (DE); Hans Peter Kutzer, Aachen (DE)

(73) Assignee: STACKPOLE INTERNATIONAL ENGINEERED PRODUCTS LTD, Ancaster, Ontario (CA)

( * ) Notice: Subject to any disclaimer, the term of this patent is extended or adjusted under 35 U.S.C. 154(b) by 20 days.

(21) Appl. No.: 13/742,237

(22) Filed: Jan. 15, 2013

(65) Prior Publication Data

US 2014/0199197 A1 Jul. 17, 2014

(51) Int. Cl.

| | |
|---|---|
| ***F04C 14/22*** | (2006.01) |
| ***F04C 2/344*** | (2006.01) |
| ***F04C 15/00*** | (2006.01) |

(52) U.S. Cl.

CPC ..... *F04C 2/344* (2013.01); *F04C 14/226* (2013.01); *F04C 15/0034* (2013.01)

(58) Field of Classification Search

CPC ..... F04C 2/32–2/46; F04C 14/226
USPC ..... 418/24–27, 30, 259, 266–268; 417/213, 417/218–220

See application file for complete search history.

(56) References Cited

U.S. PATENT DOCUMENTS

| | | | |
|---|---|---|---|
| 3,067,693 | A | 12/1962 | Lambeck |
| 4,342,545 | A | 8/1982 | Schuster |
| 4,421,462 | A | 12/1983 | Ohe |
| 4,437,819 | A | 3/1984 | Merz |
| 4,531,893 | A | 7/1985 | Okoh et al. |

(Continued)

FOREIGN PATENT DOCUMENTS

| | | | |
|---|---|---|---|
| CA | 2588817 | A1 | 6/2006 |
| DE | 3613965 | A1 | 10/1987 |

(Continued)

OTHER PUBLICATIONS

International Search Report/Written dated Oct. 2, 2014 of PCT/IB2014/000581 filed Jan. 15, 2014 (7 pages).

*Primary Examiner* — Thomas Denion
*Assistant Examiner* — Laert Dounis
(74) *Attorney, Agent, or Firm* — Pillsbury Winthrop Shaw Pittman, LLP

(57) ABSTRACT

A variable displacement vane pump has a plurality of seals between the inner surface defining the housing's internal chamber and an outer surface of the control ring. The seals define pressure regulating chambers. A first chamber is defined between a pair of seals located in a circumferential direction of the ring on opposing sides of the pivotal mounting of the ring and has at least one inlet for receiving pressurized fluid. The circumferential extent of the first chamber is greater along a portion for applying force to the ring in a second pivotal direction than along a portion for applying force in the first pivotal direction such that a net force is applied in the second pivotal direction. A second chamber has at least one outlet for receiving pressurized fluid such that the entire circumferential extent of the second chamber applies force to the ring in the second pivotal direction.

11 Claims, 2 Drawing Sheets

(56) References Cited

U.S. PATENT DOCUMENTS

| | | | | |
|---|---|---|---|---|
| 4,538,974 | A | 9/1985 | Stich et al. | |
| 4,558,998 | A | 12/1985 | Kiyoshige et al. | |
| 4,678,412 | A | 7/1987 | Dantlgraber | |
| 4,679,995 | A | 7/1987 | Bristow | |
| 4,829,769 | A | 5/1989 | Hiramatsu | |
| 5,090,881 | A | 2/1992 | Suzuki et al. | |
| 5,178,525 | A | 1/1993 | Murota | |
| 5,222,886 | A | 6/1993 | Fischer et al. | |
| 5,273,408 | A | 12/1993 | Yuge | |
| 5,366,354 | A | 11/1994 | Yuge | |
| 5,435,698 | A | 7/1995 | Phillips | |
| 5,538,400 | A | 7/1996 | Konishi et al. | |
| 5,562,432 | A | 10/1996 | Semba et al. | |
| 5,752,815 | A | 5/1998 | Muller | |
| 5,800,131 | A | 9/1998 | Lehmann et al. | |
| 6,155,797 | A | 12/2000 | Kazuyoshi | |
| 6,352,415 | B1 | 3/2002 | Uchino | |
| 6,457,946 | B2 | 10/2002 | Gretzschel et al. | |
| 6,470,992 | B2 | 10/2002 | Nissen et al. | |
| 6,530,752 | B2 | 3/2003 | Oba et al. | |
| 6,558,132 | B2 | 5/2003 | Hanggi | |
| 6,688,862 | B2 | 2/2004 | Jeronymo et al. | |
| 6,722,856 | B2 | 4/2004 | Schneider | |
| 6,763,797 | B1 | 7/2004 | Staley et al. | |
| 6,790,013 | B2 | 9/2004 | Hunter et al. | |
| 6,896,489 | B2 | 5/2005 | Hunter et al. | |
| 6,913,446 | B2 | 7/2005 | Nissen et al. | |
| 7,018,178 | B2 | 3/2006 | Hunter et al. | |
| 7,396,214 | B2 | 7/2008 | Hunter et al. | |
| 7,549,848 | B2 | 6/2009 | Scholl | |
| 7,614,858 | B2 * | 11/2009 | Tanasuca | 418/26 |
| 7,726,948 | B2 | 6/2010 | Hunter et al. | |
| 7,794,217 | B2 | 9/2010 | Williamson et al. | |
| 7,798,790 | B2 | 9/2010 | Lutoslawski et al. | |
| 8,047,822 | B2 | 11/2011 | Shulver et al. | |
| 8,057,201 | B2 | 11/2011 | Shulver et al. | |
| 8,079,826 | B2 | 12/2011 | Shulver et al. | |
| 8,202,061 | B2 * | 6/2012 | Shulver et al. | 417/216 |
| 8,297,943 | B2 | 10/2012 | Shulver et al. | |
| 8,444,395 | B2 | 5/2013 | Tanasuca et al. | |
| 8,651,825 | B2 | 2/2014 | Williamson et al. | |
| 8,684,702 | B2 * | 4/2014 | Watanabe et al. | 418/26 |
| 2001/0036412 | A1 | 11/2001 | Konishi | |
| 2009/0196780 | A1 | 8/2009 | Shulver et al. | |
| 2010/0329912 | A1 | 12/2010 | Williamson et al. | |
| 2011/0123379 | A1 * | 5/2011 | Saga et al. | 418/26 |
| 2011/0165010 | A1 | 7/2011 | Iijima | |
| 2011/0189043 | A1 | 8/2011 | Watanabe et al. | |
| 2011/0194967 | A1 | 8/2011 | Watanabe et al. | |
| 2011/0300015 | A1 | 12/2011 | Kirchner et al. | |
| 2012/0213654 | A1 * | 8/2012 | Zwickler et al. | 418/16 |
| 2013/0195705 | A1 * | 8/2013 | Williamson et al. | 418/24 |

FOREIGN PATENT DOCUMENTS

| | | | |
|---|---|---|---|
| EP | 49838 | A1 | 4/1982 |
| EP | 0 171 182 | B1 | 2/1986 |
| EP | 0 210 786 | B1 | 5/1990 |
| EP | 1 350 957 | A1 | 10/2003 |
| EP | 2253847 | A1 | 11/2010 |
| GB | 2363429 | A | 12/2001 |
| JP | 56143384 | A | 11/1981 |
| JP | 0 171 183 | A1 | 2/1986 |
| JP | 61-33272 | A | 9/1986 |
| JP | 3-275994 | A | 12/1991 |
| JP | 6-93978 | | 4/1994 |
| JP | H0693978 | A | 4/1994 |
| JP | 7-293455 | A | 11/1995 |
| JP | 10-205461 | A | 8/1998 |
| JP | 2870602 | B2 | 3/1999 |
| WO | 2006045190 | A1 | 5/2006 |
| WO | 2007128105 | A1 | 11/2007 |

* cited by examiner

VARIABLE DISPLACEMENT PUMP WITH MULTIPLE PRESSURE CHAMBERS WHERE A CIRCUMFERENTIAL EXTENT OF A FIRST PORTION OF A FIRST CHAMBER IS GREATER THAN A SECOND PORTION

FIELD OF THE INVENTION

The present invention relates to a variable displacement pump, and particularly one with multiple pressure chambers.

BACKGROUND

Variable displacement multi-chamber pumps are known in the art. However, these pumps typically have shortcomings, such as leakage issues between the control ring and housing and a limited range of pressure outputs. Examples of such pumps are disclosed in U.S. 2009/0196780 A1, U.S. 2010/0329912 , U.S. Pat. Nos. 8,057,201, 7,794,217, 4,678,412, each of which is incorporated herein in their entirety.

SUMMARY OF THE INVENTION

One aspect of the present invention provides a variable displacement vane pump comprising: a housing comprising an inner surface defining an internal chamber, at least one inlet port and at least one outlet port; a control ring pivotally mounted within the internal chamber, the control ring having an inner surface defining a rotor receiving space; and a rotor rotatably mounted within the rotor receiving chamber space of the control ring, wherein the rotor has a central axis eccentric to a central axis of the rotor receiving space. The rotor comprises a plurality of radially extending vanes mounted to the rotor for radial movement and sealingly engaged with the inner surface of the control ring such that rotating the rotor draws fluid in through the at least one inlet port by negative intake pressure and outputs the fluid out through the at least one outlet port by positive discharge pressure. A resilient structure urges the control ring in a first pivotal direction. A plurality of seals between the inner surface define the housing's internal chamber and an outer surface of the control ring, the seals defining a plurality of pressure regulating chambers comprising a first chamber and a second chamber each for receiving pressurized fluid.

The first chamber is defined between a pair of seals located in a circumferential direction of the ring on opposing sides of the pivotal mounting of the control ring and having at least one inlet for receiving pressurized fluid, the circumferential extent of the first chamber being greater along a portion for applying force to the ring in a second pivotal direction than along a portion for applying force in the first pivotal direction such that a net effect is an application of force in the second pivotal direction. The second chamber is defined between a pair of seals located in the circumferential direction of the ring and has at least one inlet for receiving pressurized fluid such that the entire circumferential extent of the second chamber applies force to the ring in the second pivotal direction.

Other objects, features, and advantages of the present invention will become apparent from the following detailed description, the accompanying drawings, and the appended claims.

DETAILED DESCRIPTION OF THE ILLUSTRATED EMBODIMENT(S)

Figure 1:
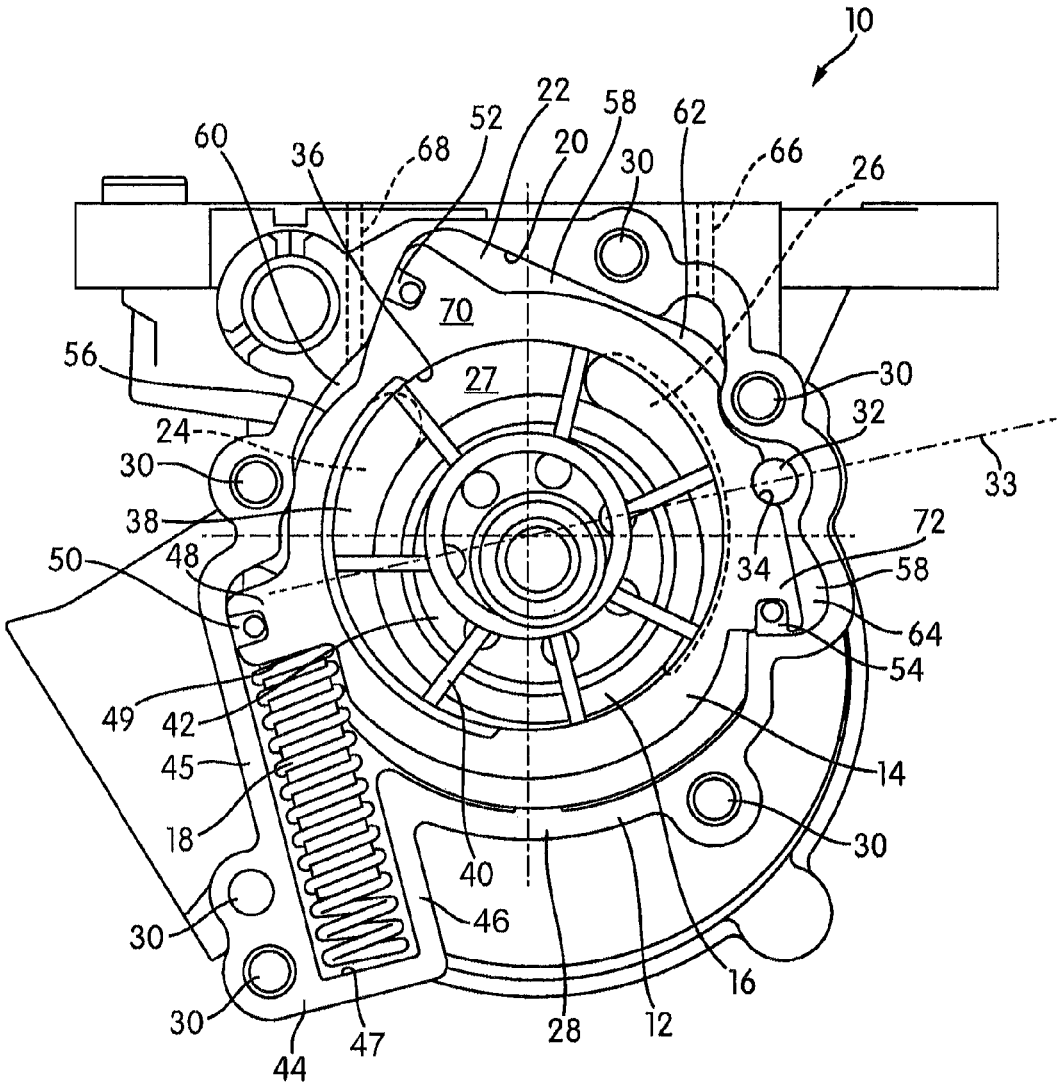
FIG. 1 is a plan view of a variable displacement pump with the cover removed.

The illustrated embodiment is a variable displacement vane pump, generally indicated at 10. The pump comprises a housing 12, a control ring 14, a rotor 16 and a resilient structure 18, as is known in the art.

The housing 12 comprises an inner surface 20 defining an internal chamber 22, at least one inlet port 24 for intaking fluid to be pumped (typically oil in the automotive context), and at least one outlet port 26 for discharging the fluid. The inlet port 24 and outlet port 26 each may have a crescent shape, and be formed through the same wall 27 located on one axial side of the housing (with regard to the rotational axis of the rotor 16). The inlet and outlet ports 24, 26 are disposed on opposing radial sides of the rotational axis of the rotor 16. These structures are conventional, and need not be described in detail. Other configurations may be used, such as differently shaped or numbered ports, etc.

The housing 12 may be made of any material, and may be formed by powdered metal casting, forging, or any other desired manufacturing technique. The housing 12 encloses the internal chamber 22. In the drawings, the main shell of the housing 12 is shown, with the wall 27 defining one axial side of the chamber 22, and a peripheral wall 28 extending around to surround the chamber 22 peripherally. A cover (not shown) attaches to the housing 12, such as by fasteners inserted into various fastener bores 30 provided along the peripheral wall 28. The cover is not shown so that the internal components of the pump can be seen, but is well known and need not be detailed. A gasket or other seal may optionally be provided between the cover and peripheral wall 28 to seal the chamber 22.

The housing includes various surfaces for accommodating movement and sealing engagement of the control ring 14, which will be described in further detail below.

The control ring 14 is pivotally mounted within the internal chamber 22. Specifically, a pivot pin or like feature 32 is provided to control the pivoting action of the control ring 22. The pivot pin 32 as shown is mounted to the housing 12 within the chamber 22, and the control ring has a concave, semicircular bearing surface 34 that rides against the pivot pin 32. In some embodiments, the pivot pin 32 may extend through a bore in the control ring 14, rather than within a concave external bearing recess. The pivotal connection may have other configurations, and these examples should not be considered limiting.

The control ring 14 has an inner surface 36 defining a rotor receiving space 38. The rotor receiving space 38 has a generally circular configuration. This rotor receiving space 38 communicates directly with the inlet and outlet openings 24, 26 for drawing in oil or another fluid under negative intake pressure through the inlet port 24, and expelling the same under positive discharge pressure out the outlet port 26.

The rotor 16 is rotatably mounted within the rotor receiving space 38 of the control ring 14. The rotor 16 has a central axis that is typically eccentric to a central axis of the rotor receiving space 38. The rotor 16 is connected to a drive input in a conventional manner, such as a drive pulley, drive shaft, or gear.

The rotor 16 comprises a plurality of radially extending vanes 40 mounted to the rotor 16 for radial movement. Specifically, the vanes 40 are mounted at their proximal ends in radial slots in the central ring or hub 42 of the rotor in a manner that allows them to slide radially. Centrifugal force may force the vanes 40 radially outwardly to maintain engagement between the vane's distal ends and the inner surface 36 of the control ring 14. This type of mounting is conventional and well known. Other variations may be used, such as springs or other resilient structures in the slots for biasing the vanes radially outwardly, and this example is not limiting. Thus, the vanes 40 are sealingly engaged with the inner surface 36 of the control ring 14 such that rotating the rotor 16 draws fluid in through the at least one inlet port 24 by negative intake pressure and outputs the fluid out through the at least one outlet port 26 by positive discharge pressure. Because of the eccentric relationship between the control ring 14 and the rotor 16, a high pressure volume of the fluid is created on the side where the outlet port 26 is located, and a low pressure volume of the fluid is created on the side where the inlet port 24 is located (which in the art are referred to as the high pressure and low pressure sides of the pump). Hence, this causes the intake of the fluid through the inlet port 24 and the discharge of the fluid through the outlet port 26. This functionality of the pump is well known, and need not be detailed further.

The resilient structure 18 urges the control ring 14 in a first pivotal direction. Specifically, the first pivotal direction is the direction that increases the eccentricity between the control ring and rotor axes. All else being static or equal, the amount of eccentricity dictates the flow in the pump, and assuming the restriction remains constant also dictates the relative difference between the discharge and intake pressures. As the eccentricity increases (the maximum position is shown in the Figures), the flow rate of the pump increases. Conversely, as the eccentricity decreases, the flow rate of the pump also drops. In some embodiments, there may be a position where the eccentricity is zero, meaning the rotor and ring axes are coaxial. In this position, the flow is zero, or very close to zero, because the high and low pressure sides have the same relative volumes. Again, this functionality of a vane pump is well known, and need not be described in further detail.

In the illustrated embodiment, the resilient structure 18 is a spring, such as a coil spring. The housing 12 may include a spring receiving portion 44, defined by portions of the peripheral wall 28 to locate and support the spring 18. The receiving portion 44 may include side walls 45, 46 to restrain the spring 18 against lateral deflection or buckling, and a bearing surface 47 against which one end of the spring is engaged. The control ring 14 includes a radially extending bearing structure 48 defining a bearing surface 49 against which the resilient structure is engaged. Other constructions or configurations may be used.

A plurality of seals 50, 52, and 54 are provided between the inner surface 20 defining the housing's internal chamber 22 and an outer surface 56 of the control ring 14. The seals 50, 52, and 54 define a plurality of pressure regulating chambers comprising a first chamber 58 and a second chamber 60 each for receiving fluid pressure. In the illustrated embodiment, two chambers are shown; however, in some embodiments more chambers could be used for finer control over pressure regulation. Similarly, although three seals are shown, additional seals could be used to define the plurality of chambers.

The first chamber 58 is defined between a pair of seals 52, 54 located in a circumferential direction of the ring 14 on opposing sides of the pivotal mounting of the control ring 14. That is, a circumferential portion 62 of the chamber 58 extends on one side of the pivotal mounting, i.e., pivot pin 32, and another circumferential portion 64 of the chamber 58 extends on the other side of the pivotal mounting. Another way this can be described is with reference to the pump's centerline 33, extending from the pivot pin to the seal 50 defining the distal end of the second chamber 60, as the portion 62 is on one side of that centerline and the portion 64 is on the other side of that centerline. The first chamber has at least one inlet 66 for receiving pressurized fluid. For example, the least one inlet port 66 may be communicated with the at least one outlet port 26 of the housing 12 for receiving the pressurized fluid under the positive discharge pressure. The pressurized fluid may be received from other sources of positive pressure as well, such as the engine oil gallery, piston squirters, etc., and diversion of the discharge pressure is not intended to be limiting.

The circumferential extent of the first chamber 58 is greater along the portion 62 for applying force to the ring 14 in a second pivotal direction than along the portion 64 for applying force in the first pivotal direction. That is, because the circumferential portions 62, 64 extend on opposing sides of the pivotal mounting, when positive pressure is supplied to the chamber 58, one portion 62 will act in the second pivotal direction against the resilient structure 18, while the other will act in the first pivotal direction with the resilient structure 18. Because portion 62 is larger than portion 64, and also because they are the same chamber 58 and will have the same pressure supplied thereto, the net effect is an application of force in the second pivotal direction.

The configuration of the first chamber 58 also has an optional advantage of reducing fluid leakage between the control ring 14 and housing 12. Specifically, the area outside the control ring 14 that is not occupied by the chambers 58, 60 is typically subject to low or no pressure, such as the negative intake pressure or ambient pressure from outside the housing. This creates a differential relative to the high pressure side inside the ring 14, which can encourage leakage of the fluid from between the axial faces of the ring 14 and the housing walls. In prior art devices, this is an issue because any pressure chamber is limited to one side of the pivotal mounting, and thus the entire area on the opposite side of the pivotal mounting is subject to low or no pressure. Since the high pressure side within the ring 14 typically extends in part radially past the pivotal mounting, this means there is an area of radial alignment between the high pressure side inside the ring 14 and the low or no pressure area outside the ring 14, which exacerbates this issue. This can be seen in FIG. 2, which shows a prior art construction with an arrow pointing into the low or no pressure area below the pivotal mounting (which where sealing defines the end of the chamber).

Figure 3:
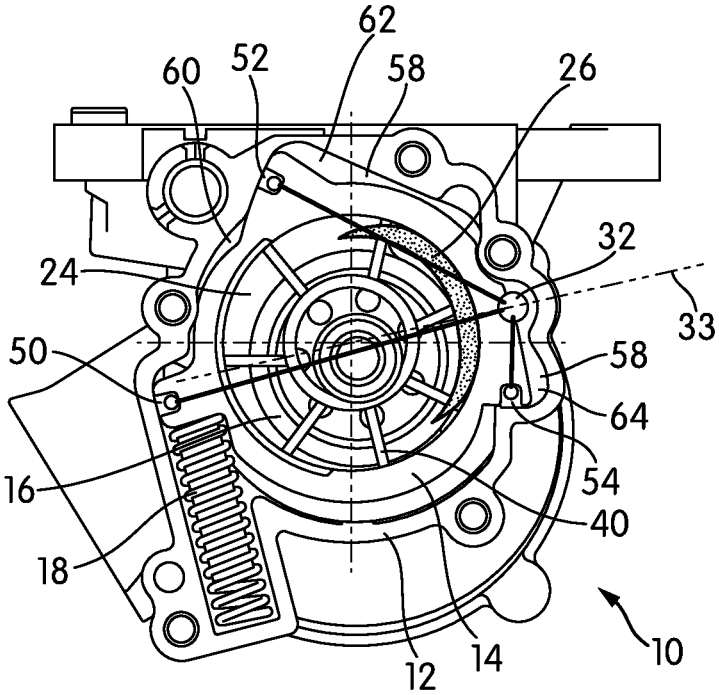
FIG. 3 is the same view as FIG. 1 with lines added to show the chamber extents.

In the illustrated embodiment, however, the first chamber 58 extends on both sides of the pivotal mounting, and specifically it has portion 64 extending on the side of the pivot pin 32 where it acts in the first pivotal direction. Thus, this extends the zone of high pressure outside the ring 14 so that there is less area of low or no pressure radially aligned with the high pressure side inside the ring 14. In turn, this reduces the amount of leakage between the ring 14 and housing 12. As can be seen in FIG. 3, the line extending below the pivot pin 32 shows the radial alignment or overlap between that portion 64 of the first chamber and the outlet port 26 (shaded) on the high pressure side in the ring 14.

The second chamber 60 is also defined between a pair of seals 50, 52 located in the circumferential direction of the ring 14. As illustrated, the two chambers 58, 60 may share a common seal 52 defining the adjacent ends of the chambers, although it is possible for them to be defined by completely separate pairs of seals also. The chamber 60 also has at least one inlet 68 for receiving pressurized fluid such that the entire circumferential extent of the second chamber applies force to the ring in the second pivotal direction. The seal 50 defining the end of the second chamber 60 is attached to the radially extending bearing structure 48, against which the spring 18 bears. The pressurized fluid may be received from any source of positive pressure, such as the outlet port 26 of the housing 12, the engine oil gallery, piston squirters, etc. The source of the pressurized fluid is not intended to be limiting. A valve, such as a solenoid or any other type of valve, may be used to control the delivery of pressurized fluid to the second control chamber 60 in any suitable manner. The source of pressure for the second control chamber may be different than the first chamber, and a lower pressure may be used in the second chamber in same embodiments.

The control ring 14 comprises a radially extending projection 70 between the first and second chambers 58, 60. The common seal 52 is attached to the radially extending projection 70. The radially extending projection 70 may be defined by two converging surfaces, as illustrated.

The control ring 14 also comprises a radially extending projection 72 at an end of the first chamber 58 opposite the second chamber 60, namely the end on the opposite side of the pivot pin 32 where the action is in the first pivotal direction. That projection may also be defined by two converging surfaces. The seal 54 is attached to that radially extending portion 72. These projections 70, 72 may have any other construction or configuration.

The housing's peripheral wall 28 also has recessed areas in which the structures carrying the seals 50, 52, 54 are located. Those recessed areas are configured based on the travel of the ring to enable the seals 50, 52, 54 to maintain contact therewith throughout the range of movement for the ring 14 and ensure the sealing. The specific geometry illustrated is not intended to be limiting, and may vary depending on the specific location of the seals, the amount of travel permitted for the ring, the overall packaging of the pump 10, etc.

Figure 2:
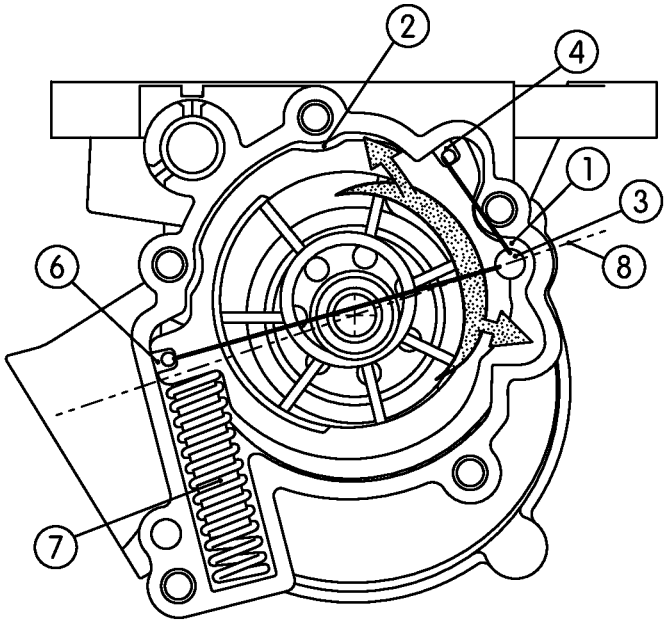
FIG. 2 (PRIOR ART)
FIG. 2 is a plan view of a prior art variable displacement pump with the cover removed.

With this construction, a wide range of pump output pressures can be achieved, while still having a relatively large size for the first chamber 58, and particularly the portion 62. The width or breadth of the range of pump output pressures is a function of the difference in forces applied by the first and second chambers 58, 60. In the prior art, the typical way to achieve this was to make the first chamber close to the pivot point relatively small, thus causing it to apply a corresponding smaller amount of force acting against the spring when supplied with pressure. Conversely, the second chamber was made relatively large, so as to apply a large amount of force when supplied with pressure. However, if the first chamber is made too small, then the second chamber may extend in radial alignment with the high pressure side inside the control ring, thus encouraging leakage during the times when no pressure is being supplied to the second chamber. This can be seen in FIG. 2, showing the prior art with an arrow indicating the leakage path from the control ring's internal high pressure side and the second chamber. Thus, the prior art has an inherent tension between decreasing the first chamber size in order to increase the difference in forces applied by the first and second chambers, and limiting leakage into the second chamber when it is not subject to pressure.

The configuration of first chamber 58 in the illustrated embodiment, however, can reduce or eliminate that issue. Because the portion 64 of chamber 58 counteracts portion 62, portion 62 can be made larger and extend further circumferentially from the pivotal mounting without increasing the net force applied by the first chamber 58 in total. That is, since portion 64 acts in the first pivotal direction and portion 62 acts in the second pivotal direction, the net application of force is the difference between the two. This allows the pump designer to extend the location of seal 52 further away from the pivotal mounting, thus reducing or eliminating the radial alignment between the second chamber 60 and the high pressure side/outlet port within the control ring 14 where leakage can occur. The portion 64 is more than de minimis so as to have actual influence on the control ring. Preferably, the portion 64 extends for at least 15 degrees from the pivotal mounting, and more preferably at least 30 degrees, with a preferred range of 20 to 50 degrees. Also, the ratio of the circumferential extent (in terms of degrees) of the chambers 58 to chamber 60 is preferably no more than 2.5, and may be no more than 3, with a preferred range of ratios between 0.75 and 2.25.

In the illustrated embodiment, the seal 52 is about 100 degrees from pivot mounting, but it could be more or less depending on various factors, such as packaging constraints, desired pressure range, etc. For example, the seal could be located at anywhere between 50-120 degrees.

The foregoing embodiments have been provided solely to illustrate the functional and structural principles of the present invention, and should not be regarded as limiting. To the contrary, the present invention encompasses all modification, alterations, and substitutions within the spirit and scope of the appended claims.

What is claimed:

1. A variable displacement vane pump comprising:

a housing comprising an inner surface defining an internal chamber, at least one inlet port and at least one outlet port;

a control ring pivotally mounted within the internal chamber, the control ring having an inner surface defining a rotor receiving space;

a rotor rotatably mounted within the rotor receiving chamber space of the control ring, wherein the rotor has a central axis eccentric to a central axis of the rotor receiving space;

the rotor comprising a plurality of radially extending vanes mounted to the rotor for radial movement and sealingly engaged with the inner surface of the control ring such that rotating the rotor draws fluid in through the at least one inlet port by negative intake pressure and outputs the fluid out through the at least one outlet port by positive discharge pressure;

a resilient structure configured to urge said control ring in a first pivotal direction;

a plurality of seals between the inner surface defining the housing's internal chamber and an outer surface of the control ring, the seals defining a plurality of pressure regulating chambers comprising a first chamber and a second chamber each for receiving pressurized fluid;

wherein the first chamber is defined between a pair of seals comprising a first seal and a second seal located in a circumferential direction of the control ring on opposing sides of the pivotal mounting of the control ring and has at least one inlet for receiving pressurized fluid, the circumferential extent of the first chamber being greater along a portion for applying force to the control ring in a second pivotal direction than along a portion for applying force in the first pivotal direction such that a net effect is an application of force in the second pivotal direction;

wherein the second chamber is defined between a pair of seals comprising a third seal located in the circumferential direction of the control ring and has at least one inlet for receiving pressurized fluid such that the entire circumferential extent of the second chamber applies force to the control ring in the second pivotal direction, the third seal being distal the first chamber in the circumferential direction;

a valve for selectively controlling delivery of pressurized fluid through the at least one inlet of the second chamber;

wherein the seals seal the first and second chambers throughout the range of movement for the control ring.

2. A variable displacement pump according to claim 1, wherein the second seal is a common seal defining adjacent ends of the first and second chambers.

3. A variable displacement pump according to claim 1, wherein the resilient structure is a spring.

4. A variable displacement pump according to claim 3, wherein the spring is a coil spring.

5. A variable displacement pump according to claim 1, wherein the control ring includes a radially extending bearing structure defining a surface against which the resilient structure is engaged.

6. A variable displacement pump according to claim 5, wherein the third seal defining an end of the second chamber is attached to said radially extending bearing structure.

7. A variable displacement pump according to claim 2, wherein said control ring comprises a radially extending projection between the first and second chambers, the common second seal being attached to the radially extending projection.

8. A variable displacement pump according to claim 7, wherein said radially extending projection is defined by two converging surfaces.

9. A variable displacement pump according to claim 1, wherein said control ring comprises a radially extending projection at an end of the first chamber opposite the second chamber, the first seal being attached to the radially extending portion.

10. A variable displacement pump according to claim 1, wherein the at least one inlet port of the first chamber is communicated with the at least one outlet port of the housing for receiving the pressurized fluid under the positive discharge pressure.

11. A variable displacement pump according to claim 1, wherein the first circumferential portion of the first chamber is defined between the pivot pin and the second seal and the second circumferential portion of the first chamber is defined between the pivot pin and the first seal, and wherein the first circumferential portion is greater than the second circumferential portion.

* * * * *